US005704825A

United States Patent [19]

LeCompte

[11] Patent Number: 5,704,825

[45] Date of Patent: Jan. 6, 1998

[54] BLAST NOZZLE

[76] Inventor: Gerard J. LeCompte, P.O. Box 891626, Houston, Tex. 77289

[21] Appl. No.: 786,824

[22] Filed: Jan. 21, 1997

[51] Int. Cl.[6] ..... B24C 5/04

[52] U.S. Cl. ..... 451/102; 451/38; 239/594

[58] Field of Search ..... 451/102, 36, 38, 451/39, 40; 239/601, 591, 592, 594, 654, 9

[56] References Cited

U.S. PATENT DOCUMENTS

| | | | |
|---|---|---|---|
| 4,817,342 | 4/1989 | Martin et al. | 451/102 |
| 5,390,450 | 2/1995 | Goenka | 451/102 |
| 5,545,073 | 8/1996 | Kneisel et al. | 451/102 |

FOREIGN PATENT DOCUMENTS

| | | | |
|---|---|---|---|
| 8900809 | 11/1990 | Denmark | 451/102 |
| 2191127 | 12/1987 | Germany | 451/102 |

*Primary Examiner*—Robert A. Rose
*Assistant Examiner*—George Nguyen
*Attorney, Agent, or Firm*—Jackie Lee Duke

[57] ABSTRACT

The improved blast nozzle comprises an inlet portion, an outlet portion and a square venturi orifice connecting the inlet and outlet portions. The inlet portion includes a square inlet for receiving the air and abrasive particle mixture with a pair of opposing flat top and bottom walls and a pair of opposing flat lateral walls. The opposing flat top and bottom walls and opposing flat lateral walls form a four sided pyramidal shape which converges to the square venturi. The outlet portion is similarly shaped and includes a pair of opposing flat top and bottom walls and a pair of opposing flat lateral walls. The opposing flat top and bottom walls and the opposing flat lateral walls form a four sided pyramidal shape also which diverges from the square venturi to a square outlet for directing the air and abrasive particle mixture. The nozzle body is typically constructed of an abrasion resistant material such as tungsten carbide. The nozzle body is then placed within an outer metal shell and a shock absorbing elastomeric material such as urethane is then cast between the nozzle body and outer metal shell to form a protective layer. The outer metal shell has threads formed on the inlet end of the nozzle to allow connection to a standard air supply line.

18 Claims, 6 Drawing Sheets

BLAST NOZZLE

BACKGROUND OF THE INVENTION

1. Field of the Invention

This invention relates to an improved blast nozzle used in abrasive blasting and cleaning with improved performance characteristics. Such blast nozzles are used in abrasive blasting in which a high speed stream of air, in which sand or other abrasive blasting material is entrained, is directed against a surface for removing rust, scale, old paint, debris and contamination from a surface prior to cleaning, repainting or applying a similar surface coating. The improved blast nozzle of the present invention produces a larger, more easily controlled blast pattern without requiring any increase in air pressure, air volume or abrasive blasting material.

The long venturi nozzle design that is the industry standard was introduced in the 1950's. This nozzle design includes a converging conical inlet section that tapers to a short straight venturi of circular cross section that connects to a diverging conical outlet section. Typically, these nozzles are operated with 100 to 150 psi air pressure and produce a typical abrasive velocity of 450 mph with a circular blast pattern.

Recent attempts to further increase productivity of the long venturi nozzle have included operating these nozzles at higher pressures exceeding 150 psi. While tests have shown increased productivity at these higher pressures, these pressures exceed the safety limits of most contractors' equipment. The improved blast nozzle of the current invention offers a substantial increase in productivity utilizing prevailing operating techniques without requiring any increase in required air pressure for operating the nozzle.

2. Description of Related Art

Various types of nozzles utilizing various shapes to form and direct the outlet stream are well known in the prior art. These prior devices all fail in one or more respects to address the problems described.

U.S. Pat. No. 2,605,596 to Uhri discloses a method of cleaning surfaces utilizing a fan shaped nozzle to direct a sand and water slurry with air pressure.

U.S. Pat. No. 4,633,623 to Spitz shows a sand blasting nozzle with a diverging outlet with flat sides to produce a flat output stream.

U.S. Pat. No. 4,843,770 to Crane et al. discloses a supersonic fan nozzle with a wide exit swath.

U.S. Pat. No. 5,283,990 to Shank, Jr. shows a blast nozzle with an inlet flow straightener to facilitate mixing of the abrasive in the air stream.

U.S. Statutory Invention Registration H1379 to Meuer discloses a supersonic fan nozzle particularly suited for use with plastic abrasive media.

U. S. Pat. No. Re. 34,854 to Shank, Jr. shows another fan nozzle adapted for use with sodium bicarbonate as the blast media.

Venezuelan Patent Registration No. 51.699 to Leaño Ortega shows a venturi nozzle with a conical inlet section and a square outlet section.

SUMMARY OF THE INVENTION

In view of the disadvantages with the known types of blast nozzles, the present invention provides an improved blast nozzle with substantially improved performance characteristics over the conventional long venturi nozzle without requiring any increase in air pressure or abrasive blasting media.

The improved blast nozzle includes a nozzle liner surrounded by a protective outer body. The nozzle liner comprises an inlet portion, an outlet portion and a square venturi orifice connecting the inlet and outlet portions. The inlet portion has a converging interior volume including a square inlet for receiving the air and abrasive particle mixture with a pair of opposing flat top and bottom walls and a pair of opposing flat lateral walls. The opposing flat top and bottom walls and opposing flat lateral walls form a four sided pyramidal shape which converges to the square venturi. The outlet portion is similarly shaped and includes a pair of opposing flat top and bottom walls and a pair of opposing flat lateral walls to form a diverging interior volume. The opposing flat top and bottom walls and the opposing flat lateral walls form a four sided pyramidal shape also which diverges from the square venturi to a square outlet for directing the air and abrasive particle mixture.

The nozzle liner is typically constructed of an abrasion resistant material such as tungsten carbide. The nozzle liner is then placed within an outer body. The outer body includes an outer sheath of metal and a shock absorbing inner sheath. The inner sheath is an elastomeric material such as urethane that is cast between the nozzle liner and outer sheath to form a protective layer. The outer body has threads formed on the outer sheath adjacent the inlet end of the nozzle liner to allow connection to a standard blast hose supply line.

It is a principal object of the present invention to provide an improved blast nozzle with enhanced performance characteristics that does not require any increase in air pressure or blast media consumption.

Another object of the present invention is to provide an improved blast nozzle which produces a substantially square blast pattern which reduces the overlap required for each pass of the blast nozzle.

A further object of the present invention is to provide an improved blast nozzle with enhanced performance characteristics that is easily manufactured using currently available manufacturing techniques.

A final object of the present invention is to provide an improved blast nozzle with enhanced performance characteristics that is easily manufactured with an abrasion resistant liner using currently available manufacturing techniques.

These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENT

Figure 1:
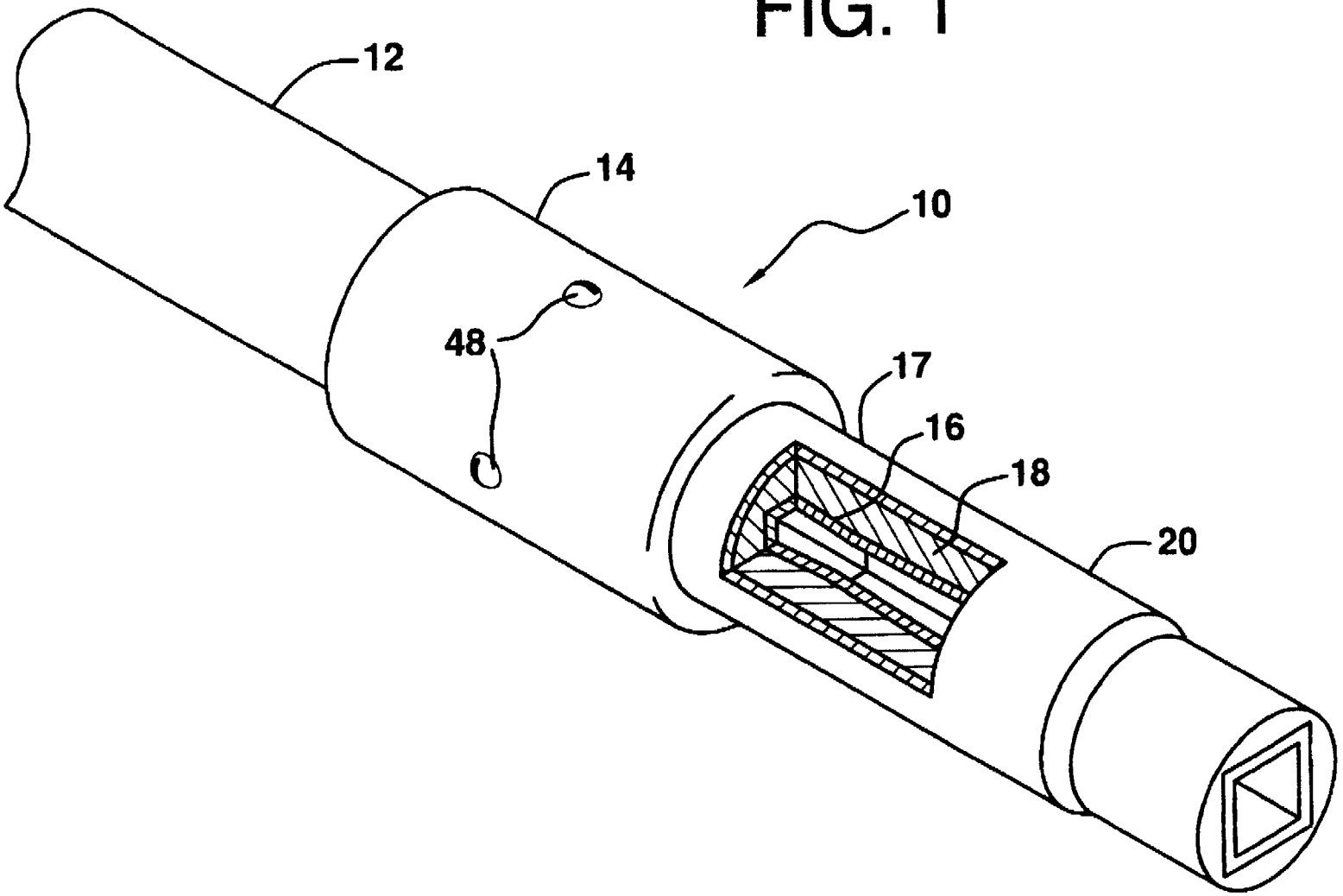
FIG. 1 is a perspective view of one embodiment of the improved blast nozzle with a removed section to show the inlet and outlet shapes and the square venturi in accordance with the present invention.

With reference to the drawings, and particularly to FIG. 1, the preferred embodiment of the improved blast nozzle of the present invention is denoted generally by reference numeral 10. Improved blast nozzle 10 is connected to an abrasive blast supply hose 12 by means of threaded coupling 14. Alternatively, a twist lock connector well known to those of ordinary skill in the art could be substituted for threaded coupling 14. Abrasive blast supply hose 12 is connected to a blast machine (not shown) which provides the propellant fluid, air, and the abrasive particle mixture, typically sand or other abrasive.

Figure 2:
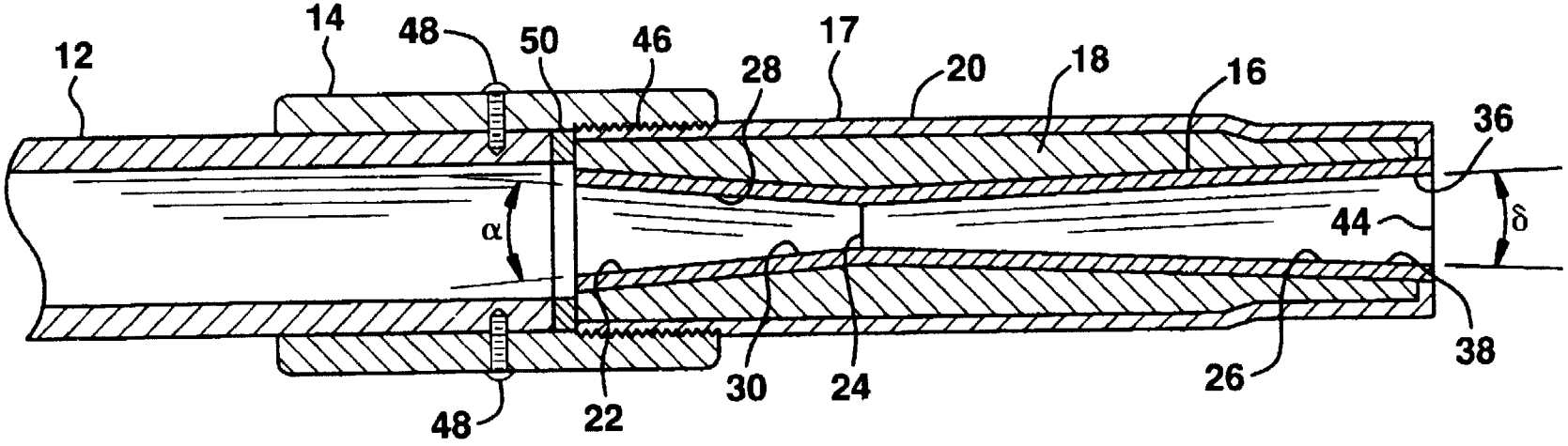
FIG. 2 is a sectional view of FIG. 1 showing the details of the blast nozzle's construction.

Improved blast nozzle 10 is composed of nozzle liner 16 and outer body 17. Outer body 17 includes inner sheath 18 and outer sheath 20. A sectional view of improved blast nozzle 10 is shown in FIG. 2 that shows details of the construction of nozzle liner 16, inner sheath 18 and outer sheath 20. Nozzle liner 16 may be formed of any suitable abrasion resistant material such as hardened tool steel, tungsten carbide, silicon carbide or boron carbide.

Figure 3:
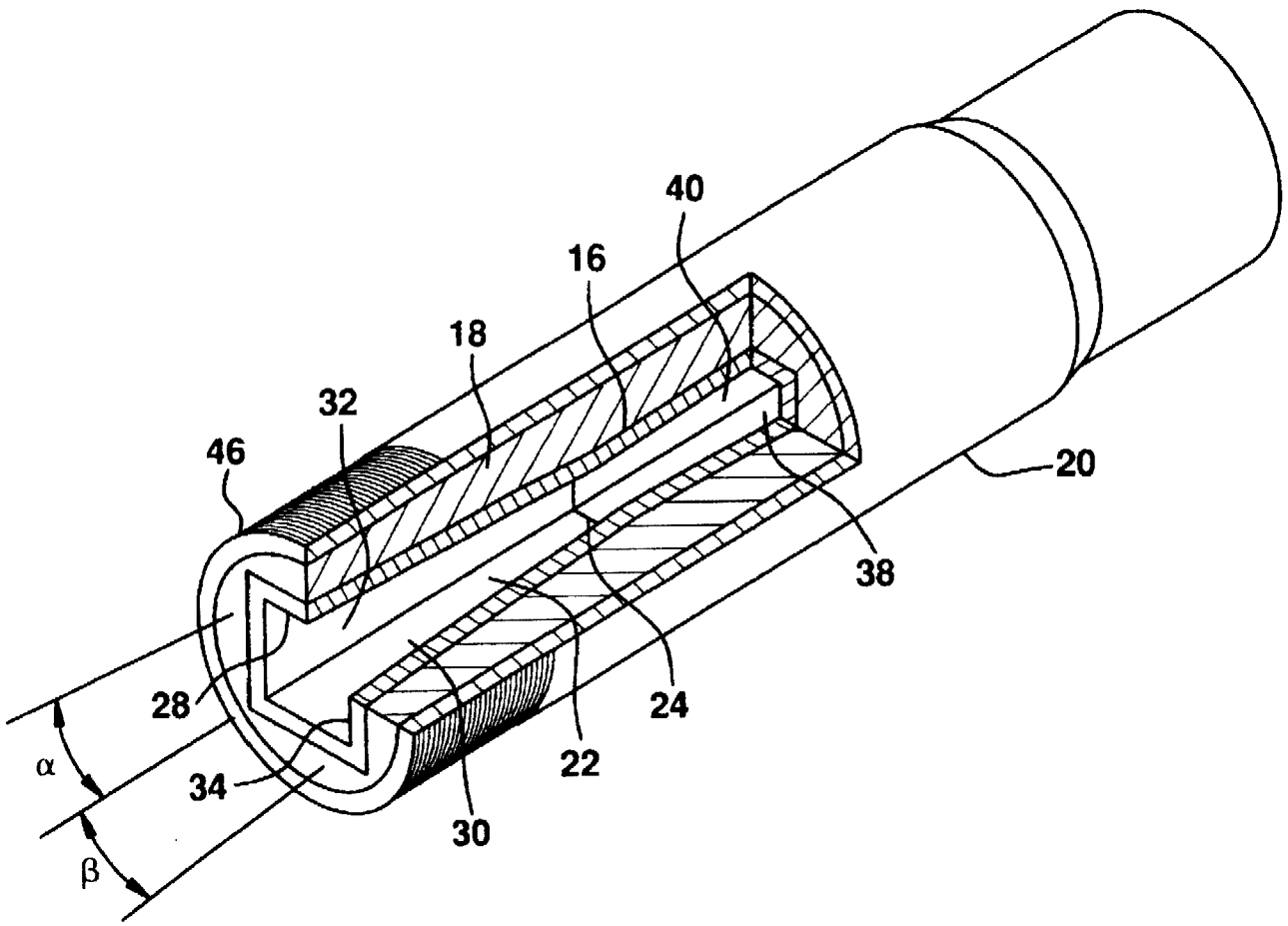
FIG. 3 is a perspective view of the improved blast nozzle with the blast hose removed and a removed section to show the inlet shape and the threads for connection to a blast hose.

Nozzle liner 16 includes inlet portion 22, square cross section venturi 24 and outlet portion 26. As may be seen most clearly in FIG. 3, inlet portion 22 has a pair of opposing flat top and bottom walls 28 and 30, respectively, and a pair of opposing lateral walls 32 and 34, respectively, which form a converging interior volume. Opposing flat top and bottom walls 28 and 30 form an angle $\alpha$ which converges to square cross section venturi 24. Similarly, opposing lateral walls 32 and 34 form an angle $\beta$ which converges to square cross section venturi 24. Angles $\alpha$ and $\beta$ are equal so that opposing flat top and bottom walls 28 and 30 and opposing lateral walls 32 and 34 form a four sided pyramidal shape with equally sized walls. The pyramidal shape is truncated at square venturi 24.

Figure 4:
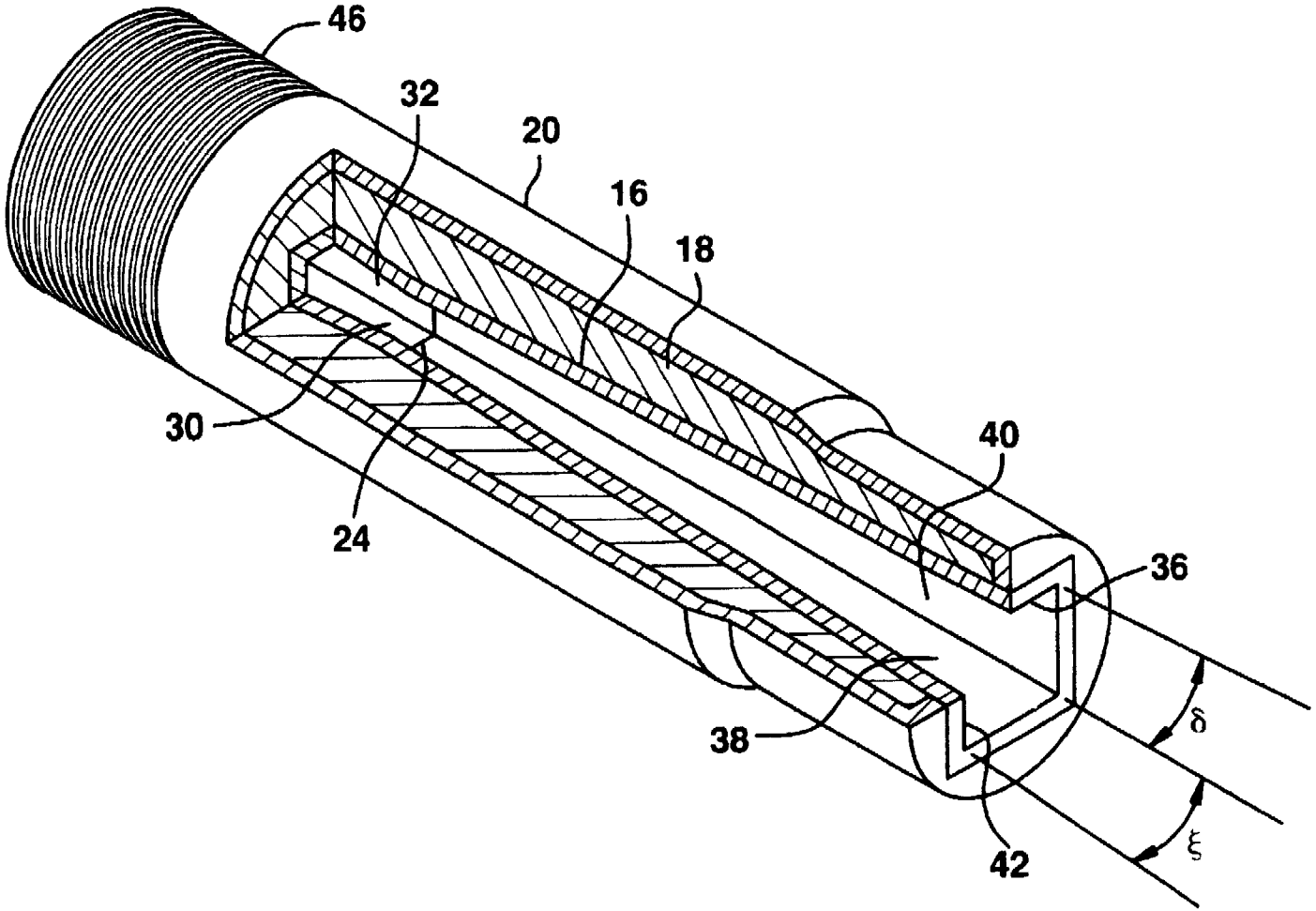
FIG. 4 is a perspective view of the improved blast nozzle with the air hose removed and a removed section to show the outlet shape.

FIG. 4 shows outlet portion 26 has a pair of opposing flat top and bottom walls 36 and 38, respectively, and a pair of opposing lateral walls 40 and 42, respectively, which form a diverging interior volume. Opposing flat top and bottom walls 36 and 38 form an angle $\delta$ which diverges from square cross section venturi 24 to square outlet 44. Similarly, opposing lateral walls 40 and 42 form an angle $\epsilon$ which diverges from square cross section venturi 24 to square outlet 44. Angles $\delta$ and $\epsilon$ are equal so that opposing flat top and bottom walls 36 and 38 and opposing lateral walls 40 and 42 form a four sided pyramidal shape with equally sized walls. The pyramidal shape is truncated at square venturi 24. In the preferred embodiment, angles $\alpha$ and $\beta$ are equal but different from angles $\delta$ and $\epsilon$ which are equal.

Referring back to FIG. 2, outer sheath 20 is sized to fit closely about nozzle liner 16. Threads 46 are formed on the exterior of outer sheath 20 to engage coupling 14 which is attached to abrasive blast supply hose 12. Screws 48 are disposed radially around coupling 14 to attach abrasive blast supply hose 12 to coupling 14. Seal element 50 is disposed between abrasive blast supply hose 12 and blast nozzle 10 to ensure proper sealing. Inner sheath 18 is formed of a suitable shock absorbing material such as urethane which is poured or cast in place in the annulus between nozzle liner 16 and outer sheath 20.

An alternate construction of outer body 17 combines inner sheath 18 and outer sheath 20 into a single structure. In this alternate construction, inner sheath 18 and outer sheath 20 are formed as a single body. The material used may be urethane, pot metal or similarly suitable material. In either case, the urethane or pot metal is cast or poured around the nozzle liner 16. In the case of urethane, threads 46 are formed in the outer surface of outer body 17 during molding. In the case of pot metal, threads 46 are machined in the outer surface of outer body 17. The blast nozzle 10 thus formed is connected to coupling 14 as previously described.

Figure 6:
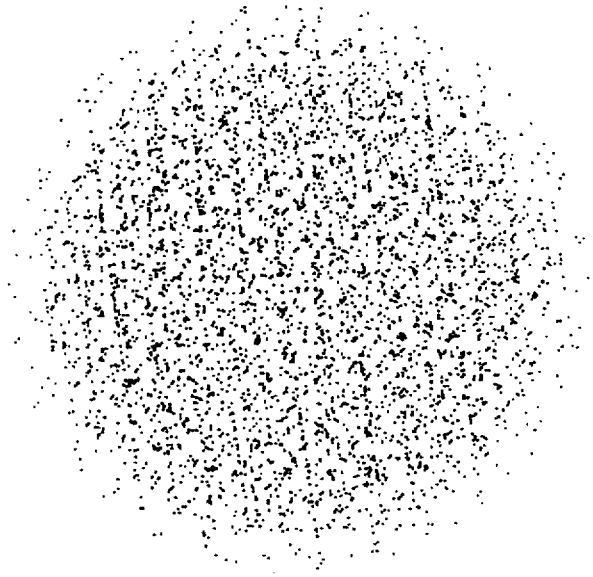
FIG. 6 is a view of the blast pattern produced by a conventional long venturi blast nozzle.
Figure 5:
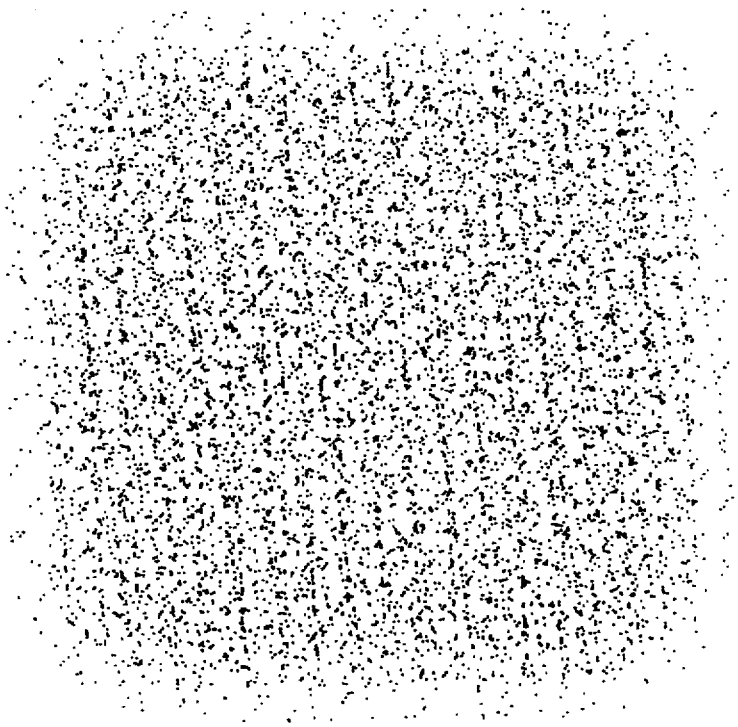
FIG. 5 is a view of the blast pattern produced by the improved blast nozzle of the present invention.

FIG. 5 is a view of the blast pattern produced by the improved blast nozzle of the present invention on a test plate while FIG. 6 is a view of the blast pattern produced by a conventional long venturi blast nozzle on a similar test plate. Comparison of FIGS. 5 and 6 show the improved blast nozzle of the present invention produces an effective cleaned area which is approximately 50% greater than that of the area cleaned by a conventional long venturi blast nozzle. This is done without any additional air pressure or abrasive consumption, thereby producing a significant improvement in productivity.

Figure 7:
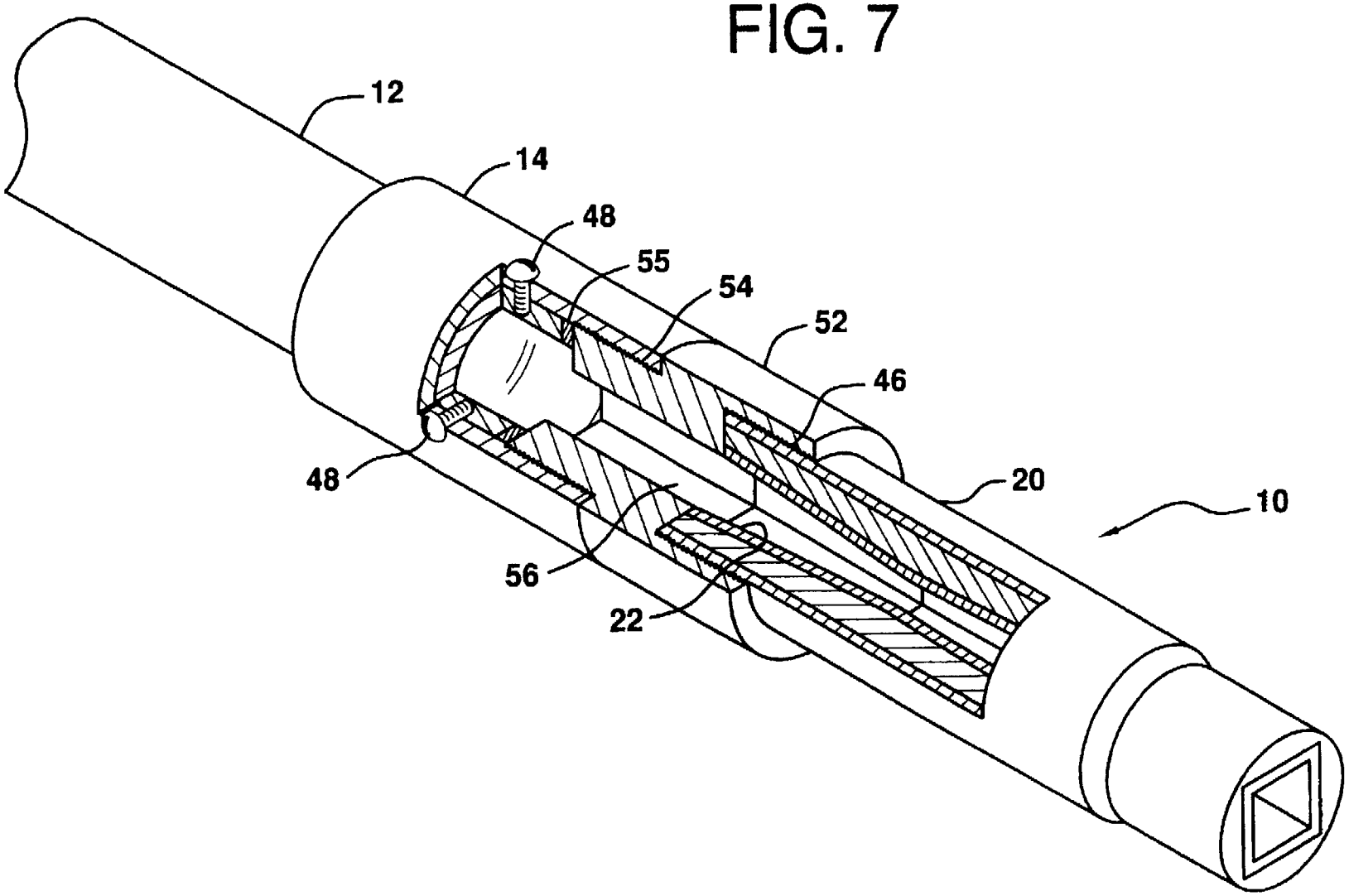
FIG. 7 is a perspective view of an alternate embodiment of the improved blast nozzle with a removed section to show the addition of a flow straightener before the inlet portion of the blast nozzle.

FIG. 7 is a perspective view of an alternate embodiment of the improved blast nozzle with a removed section to show the addition of a flow straightener before the inlet portion of the blast nozzle. Those items which are identical to the first embodiment retain their numeric designations. Improved blast nozzle 10 has threads 46 formed on the exterior of outer sheath 20 as previously described. Flow straightener 52 attaches to improved blast nozzle 10 by threads 46. Flow straightener 52 has threads 54 formed on the exterior at its opposite end which attach to coupling 14. Seal element 55 is disposed between abrasive blast supply hose 12 and flow straightener 52 to ensure proper sealing. The details of the construction of coupling 14 and its attachment to abrasive blast supply hose 12 are the same as in the original embodiment. Flow straightener 52 has a square cross section interior 56 which is sized to match the square inlet portion 22 of blast nozzle liner 16. Flow straightener 52 is designed to be of sufficient length to allow the propellant fluid, air, and the abrasive particle mixture, typically sand, to attain an even distribution across the square cross section interior 56 after having left the round cross section abrasive blast supply hose 12. By ensuring the air and abrasive particle mixture are evenly distributed before reaching square inlet portion 22, the blast nozzle is able to produce a more "square" blast pattern as previously shown. This ensures greater productivity from the improved blast nozzle 10 as previously discussed.

The construction of my improved blast nozzle will be readily understood from the foregoing description and it will be seen I have provided an improved blast nozzle with enhanced performance characteristics that does not require any increase in air pressure or blast media consumption to provide a substantially square blast pattern. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. A nozzle liner for the mixing of a propellant fluid and an abrasive particle mixture, said nozzle liner comprising:

an inlet portion and an outlet portion, said inlet portion having a converging interior volume of square cross section, said outlet portion having a diverging interior volume of square cross section, and said inlet portion converging interior volume and said outlet portion diverging interior volume tapering to a square cross section venturi intermediate said inlet and said outlet portions to provide fluid communication between said converging interior volume and said diverging interior volume.

2. A nozzle liner for the mixing of a propellant fluid and an abrasive particle mixture according to claim 1 wherein:

said nozzle liner is composed of an abrasion resistant material.

3. A nozzle liner for the mixing of a propellant fluid and an abrasive particle mixture according to claim 2 wherein:

said abrasion resistant material is tungsten carbide, silicon carbide, silicon nitride, or boron carbide.

4. A nozzle for the mixing of a propellant fluid and an abrasive particle mixture, said nozzle comprising:

a nozzle liner having an inlet portion and an outlet portion, said inlet portion having a converging interior volume of square cross section, said outlet portion having a diverging interior volume of square cross section, and said inlet portion converging interior volume and said outlet portion diverging interior volume tapering to a square cross section venturi intermediate said inlet and said outlet portions to provide fluid communication between said converging interior volume and said diverging interior volume, and an outer body surrounding said nozzle liner.

5. A nozzle for the mixing of a propellant fluid and an abrasive particle mixture according to claim 4 wherein:

said nozzle liner is composed of an abrasion resistant material.

6. A nozzle for the mixing of a propellant fluid and an abrasive particle mixture according to claim 5 wherein:

said nozzle liner abrasion resistant material is tungsten carbide, silicon carbide, silicon nitride, or boron carbide.

7. A nozzle for the mixing of a propellant fluid and an abrasive particle mixture according to claim 6 wherein said outer body includes:

coupling means adjacent said inlet portion for connecting said nozzle to a propellant fluid supply means.

8. A nozzle for the mixing of a propellant fluid and an abrasive particle mixture according to claim 7 wherein:

said coupling means is a threaded connection.

9. A nozzle for the mixing of a propellant fluid and an abrasive particle mixture according to claim 8 wherein said outer body includes:

an outer sheath surrounding said nozzle liner, and an inner sheath between said nozzle liner and said outer sheath to provide an impact resistant layer.

10. A nozzle liner for the mixing and accelerating of a propellant fluid and an abrasive particle mixture, said nozzle liner comprising:

an inlet portion, an outlet portion and a square cross section venturi orifice connecting said inlet portion and said outlet portion, said inlet portion including a square inlet for receiving said propellant fluid and abrasive particle mixture and having a first pair of opposing flat top and bottom walls, a first pair of opposing flat lateral walls, said first pair of opposing flat top and bottom walls and said first pair of opposing flat lateral walls converging to said square cross section venturi, and said outlet portion including a square outlet for directing said propellant fluid and abrasive particle mixture and having a first pair of opposing flat top and bottom walls, a first pair of opposing flat lateral walls, said first pair of opposing flat top and bottom walls and said first pair of opposing flat lateral walls diverging from said square venturi to said outlet.

11. A nozzle for the mixing of a propellant fluid and an abrasive particle mixture according to claim 10 wherein:

said nozzle liner is composed of an abrasion resistant material.

12. A nozzle liner for the mixing of a propellant fluid and an abrasive particle mixture according to claim 11 wherein:

said abrasion resistant material is tungsten carbide, silicon carbide, silicon nitride, or boron carbide.

13. A nozzle for the mixing and accelerating of a propellant fluid and an abrasive particle mixture, said nozzle comprising:

a nozzle liner having an inlet portion, an outlet portion and a square cross section venturi orifice connecting said inlet portion and said outlet portion, said inlet portion including a square inlet for receiving said propellant fluid and abrasive particle mixture and having a first pair of opposing flat top and bottom walls, a first pair of opposing flat lateral walls, said first pair of opposing flat top and bottom walls and said first pair of opposing flat lateral walls converging to said square cross section venturi, said outlet portion including a square outlet for directing said propellant fluid and abrasive particle mixture and having a first pair of opposing flat top and bottom walls, a first pair of opposing flat lateral walls, said first pair of opposing flat top and bottom walls and said first pair of opposing flat lateral walls diverging from said square venturi to said outlet, and an outer body surrounding said nozzle liner.

14. A nozzle for the mixing and accelerating of a propellant fluid and an abrasive particle mixture according to claim 13 wherein:

said nozzle liner is composed of an abrasion resistant material.

15. A nozzle for the mixing and accelerating of a propellant fluid and an abrasive particle mixture according to claim 14 wherein:

said nozzle liner abrasion resistant material is tungsten carbide, silicon carbide, silicon nitride, or boron carbide.

16. A nozzle for the mixing and accelerating of a propellant fluid and an abrasive particle mixture according to claim 15 wherein said outer body includes:

coupling means adjacent said inlet portion for connecting said nozzle to a propellant fluid supply means.

17. A nozzle for the mixing and accelerating of a propellant fluid and an abrasive particle mixture according to claim 16 wherein:

said coupling means is a threaded connection.

18. A nozzle for the mixing and accelerating of a propellant fluid and an abrasive particle mixture according to claim 17 wherein said outer body includes:

an outer sheath surrounding said nozzle liner, and an inner sheath between said nozzle liner and said outer sheath to provide an impact resistant layer.

* * * * *